US006854294B2

(12) United States Patent
Willmer et al.

(10) Patent No.: US 6,854,294 B2
(45) Date of Patent: Feb. 15, 2005

(54) METHOD AND KNITTING MACHINE FOR PRODUCING KNITWEAR, ESPECIALLY FROM HARD, INELASTIC THREAD MATERIAL

(75) Inventors: Rolf Willmer, Albstadt (DE); Hermann Stauss, Albstadt (DE)

(73) Assignee: SIPRA Patententwicklungs- und Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 10/818,483

(22) Filed: Apr. 5, 2004

(65) Prior Publication Data

US 2004/0200242 A1 Oct. 14, 2004

(30) Foreign Application Priority Data

Apr. 8, 2003 (DE) ..... 103 16 702

(51) Int. Cl.[7] ..... D04B 15/06
(52) U.S. Cl. ..... 66/104
(58) Field of Search ..... 66/9 R, 91, 90, 66/92, 93, 104, 19

(56) References Cited

U.S. PATENT DOCUMENTS 3,054,278 A 9/1962 Haddad
4,693,092 A * 9/1987 Plath ..... 66/55
4,879,885 A * 11/1989 Kuhn ..... 66/54
4,955,211 A * 9/1990 Neher ..... 66/9 R
5,239,843 A * 8/1993 Plath et al. ..... 66/92
5,279,133 A * 1/1994 Plath ..... 66/9 R
5,791,162 A * 8/1998 Plath ..... 66/92

FOREIGN PATENT DOCUMENTS

| | | |
|---|---|---|
| DE | 516 317 | 1/1931 |
| DE | 31 45 307 A1 | 6/1983 |
| DE | 33 48 030 | 3/1986 |
| DE | 34 33 290 A1 | 3/1986 |
| DE | 39 28 986 A1 | 3/1991 |
| DE | 40 33 735 A1 | 4/1992 |

* cited by examiner

*Primary Examiner*—Danny Worrell
(74) *Attorney, Agent, or Firm*—Michael J. Striker

(57) ABSTRACT

A knitting machine and a method to be accomplished on said machine are described, which are suitable for the production of knitwear from hard, inelastic thread material, e.g. from metal threads. According to the invention, at knitting systems (8*a*, 8*b*) provided for this purpose, knitting needles (2) are raised to pick up threads, which are then preformed over the upper edges of knocking-over/holding-down sinkers (3) to form loops. Thereafter the stitch formation takes place by needle and sinker movements directed in opposite directions in the manner of the relative technique.

12 Claims, 8 Drawing Sheets

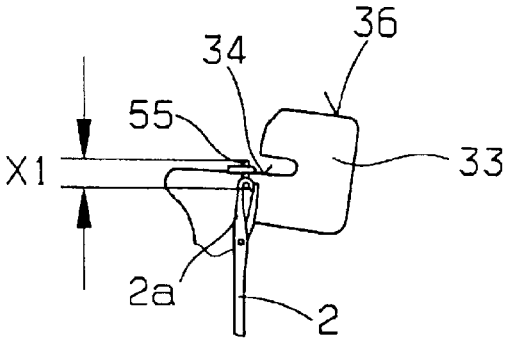
Fig.20.
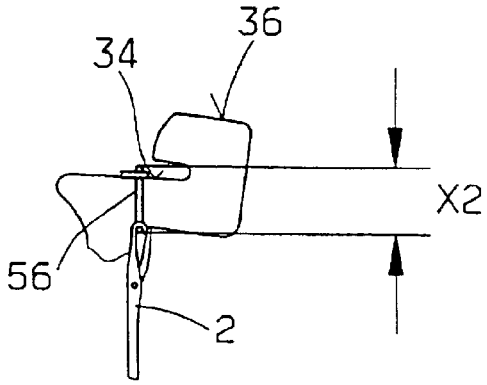
Fig.21.
Fig.22.
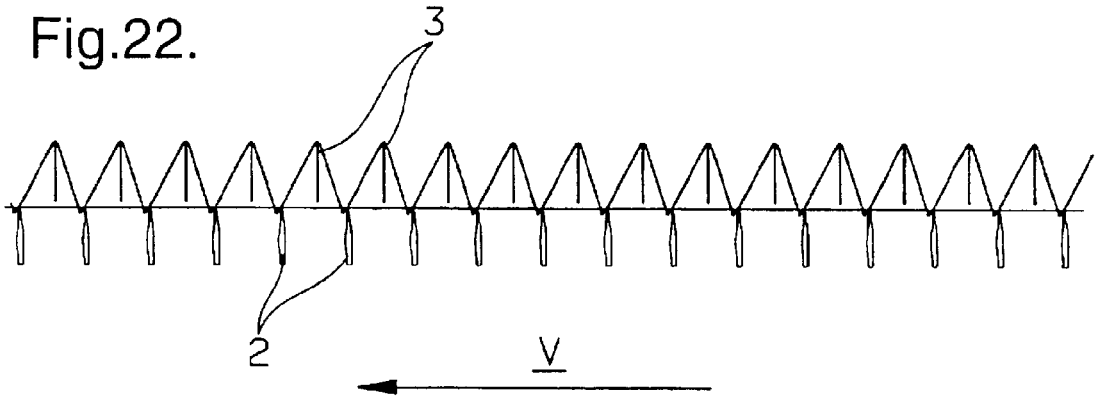
Fig.23.
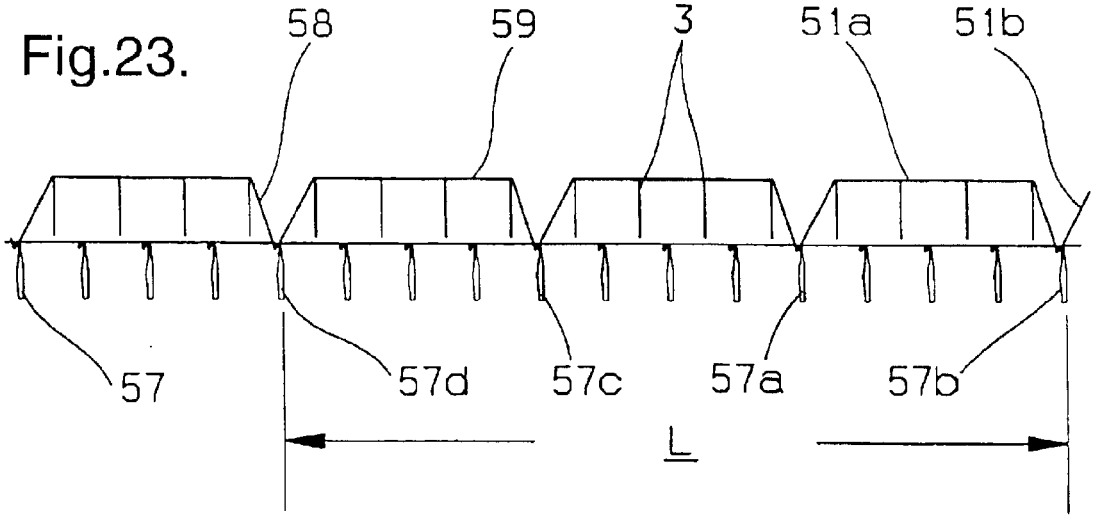

METHOD AND KNITTING MACHINE FOR PRODUCING KNITWEAR, ESPECIALLY FROM HARD, INELASTIC THREAD MATERIAL

BACKGROUND OF THE INVENTION

The invention relates to a knitting machine and a method to be carried out on said machine for producing knitwear which has stitches, especially from hard, inelastic thread material, using knitting needles and holding-down/knocking-over sinkers associated therewith.

The need for industrial textiles consisting of knitted fabrics or produced from same is ever increasing. This applies on the one hand also to knitted fabrics produced with knitting machines, especially circular knitting machines, on the other hand to products which are produced from hard thread materials which have little or no elasticity, such as for example metal wires spun from staple fibres, monofil continuous wires produced e.g. from copper or brass, or the like. A previously unavoidable disadvantage consists here in the fact that thread materials of this type can only be processed with difficulty on knitting machines and, especially at high processing speeds, frequently lead to the thread breaking.

Therefore there has already been known for a long time (DE-PS 516 317) a way of providing a rib circular machine for processing hard threads, in which the threads, before the actual stitch formation (sinking the loops), are preformed over additionally present holding-down and knocking-over sinkers to form loops. This preforming (preliminary loop sinking) takes place in that the knitting needles, after picking up the thread, are taken down into an intermediate position in order thus to lay or pull the threads over associated high sinker edges. Simultaneously with this, the sinkers are preferably raised in an opposite direction in order to carry out the preforming of the loops with the needles and sinkers together. Following this, the formed loops are transferred to the knocking-over edges of the sinkers, whereupon the usual stitch formation takes place by a further take-down solely of the knitting needles. Set against the advantage of the preparation of the stitch formation which is made possible by the preforming and which is gentle on the thread material, is the disadvantage that neither the length of the preformed loops nor the size of the formed stitches can be altered. Moreover no patterns can be produced.

The preforming of threads into loops is also generally known in the case of knitting machines for producing plush goods (e.g. DE 31 45 307 C2, DE 40 33 735 C2). The length of ground thread loops can here be made adjustable (e.g. DE 41 29 845 A1) in that the ground threads are laid over special drawing edges of sinkers and the sinkers are then pushed radially forwards to different extents with the aid of adjustable cams. On the other hand, the plush threads in the same machine are laid over the upper edges of the sinkers and are taken down to different depths by the knitting needles with the aid of adjustable cams. This results in a comparatively complicated machine structure which can admittedly be justified for the production of plush goods but would be much too expensive for the production of mainly monofil knitted goods produced from metal threads or the like.

In addition to this, methods and circular knitting machines suitable for carrying out same are known (DE 33 11 361 A1) which operate with the so-called relative technique and are distinguished in that the knitting needles and holding-down and knocking-over sinkers disposed between them carry out movements in opposite directions during the stitch formation (couliering, loop sinking). Thus on the one hand the use of less steep cams for the knitting needles and sinkers is possible. On the other hand, it is possible to work at greater speeds without there being the danger of thread breakage. In principle, therefore, such circular knitting machines should also be suitable for the gentle processing of inelastic threads. Moreover the additional advantage could be exploited that in the relative technique there is the possibility of forming stitches of differing lengths according to requirements and/or undertaking patterns (DE 33 48 030 C2, DE 34 33 290 C2, DE 39 28 986 C2). However, set against this is the disadvantage that knitting machines of this type do not make possible any preforming of the threads into loops.

SUMMARY OF THE INVENTION

Starting from the prior art discussed above, an object underlying the present invention is to make the method and the knitting machine of the kind as specified above suitable for producing knitwear which has stitches of differing length.

Another object of this invention is to so improve the method and the knitting machine of the kind mentioned above that knitwear having stitches of differing lengths can be produced with low technical outlay and with a gentle, non tendering treatment of the thread.

A further object of the present invention is to create a method and a knitting machine of the kind specified above in such a manner that also knitwear having patterns can be produced.

Yet a further object of the present invention is to make the method and the knitting machine specified above particularly suitable for producing knitwear from hard, inelastic thread material.

These and other objects are solved in accordance with the present invention by means of a method according to claim 1 and a knitting machine according to claim 6.

According to the present invention and claim 1 the method of producing knitwear which has stitches, especially from hard, inelastic thread material, on a knitting machine which is provided with knitting needles and holding-down/knocking over sinkers associated therewith, comprises the following steps: raising knitting needles on knitting systems provided for this purpose to pick up threads, taking down the raised knitting needles into an intermediate position in order to preform the picked-up threads over the sinkers to form loops of pre-selected length, and forming the stitches by taking down the knitting needles from the intermediate position into a lowermost position and raising the sinkers in a direction which is opposite thereto.

According to the present invention and claim 5 the knitting machine for producing knitwear which has stitches, especially from a hard, inelastic thread material, comprises a support, in which knitting needles and holding-down/knocking-over sinkers are disposed alternately beside one another, and at least one knitting system, which has a raising cam to raise the knitting needles, at least one thread guide to lay a thread into the raised knitting needles and a stitch-formation section with cams, by means of which opposite movements are assigned to the knitting needles and sinkers, in order to form stitches from the laid threads, wherein the knitting system has between the raising cam and the stitch-formation section a specific drawing-down edge drawing a raised knitting needle down into an intermediate position, to form thread loops over the sinkers.

Due to the invention it is possible for the first time to combine the advantages of preliminary loop sinking with the advantages of the so-called relative technique. This combination is achieved according to the invention moreover with simple constructional means and without foregoing optional alteration of the stitch length or the production of construction patterns such as are possible in particular using the three-way technique (knit, miss-knit and tuck). Critical for this is that according to the invention initially, if required, a pattern is undertaken, thereafter the preliminary loop sinking takes place and finally the stitch formation using the relative technique is carried out.

Further advantageous features of the invention arise from the subordinate claims.

BRIEF DESCRIPTION OF THE DRAWINGS

FIG. 22 schematically, a stitch formation with all the knitting needles present; and FIG. 23 schematically, the production of float loop patterns by forming stitches with each fourth knitting needle present.

DESCRIPTION OF THE PREFERRED EMBODIMENTS

Figure 1:
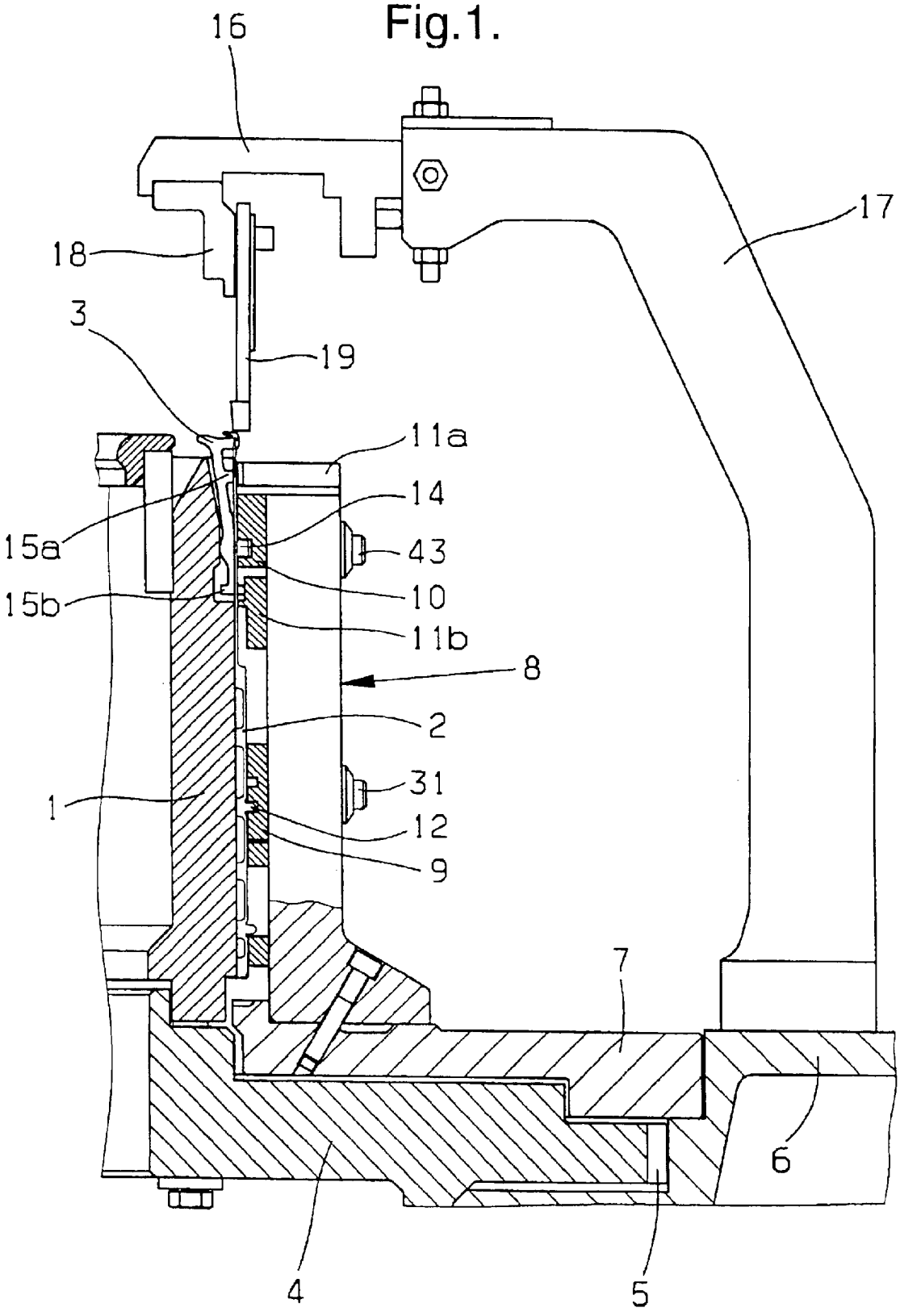
FIG. 1 a schematic axial section through a circular knitting machine according to the invention, FIGS. 2 and 3 an outer and an inner view, respectively, of a knitting system of the circular knitting machine according to FIG. 1, together with a set of the knitting needles and holding-down/knocking-over sinkers used by way of example.
Figure 2:
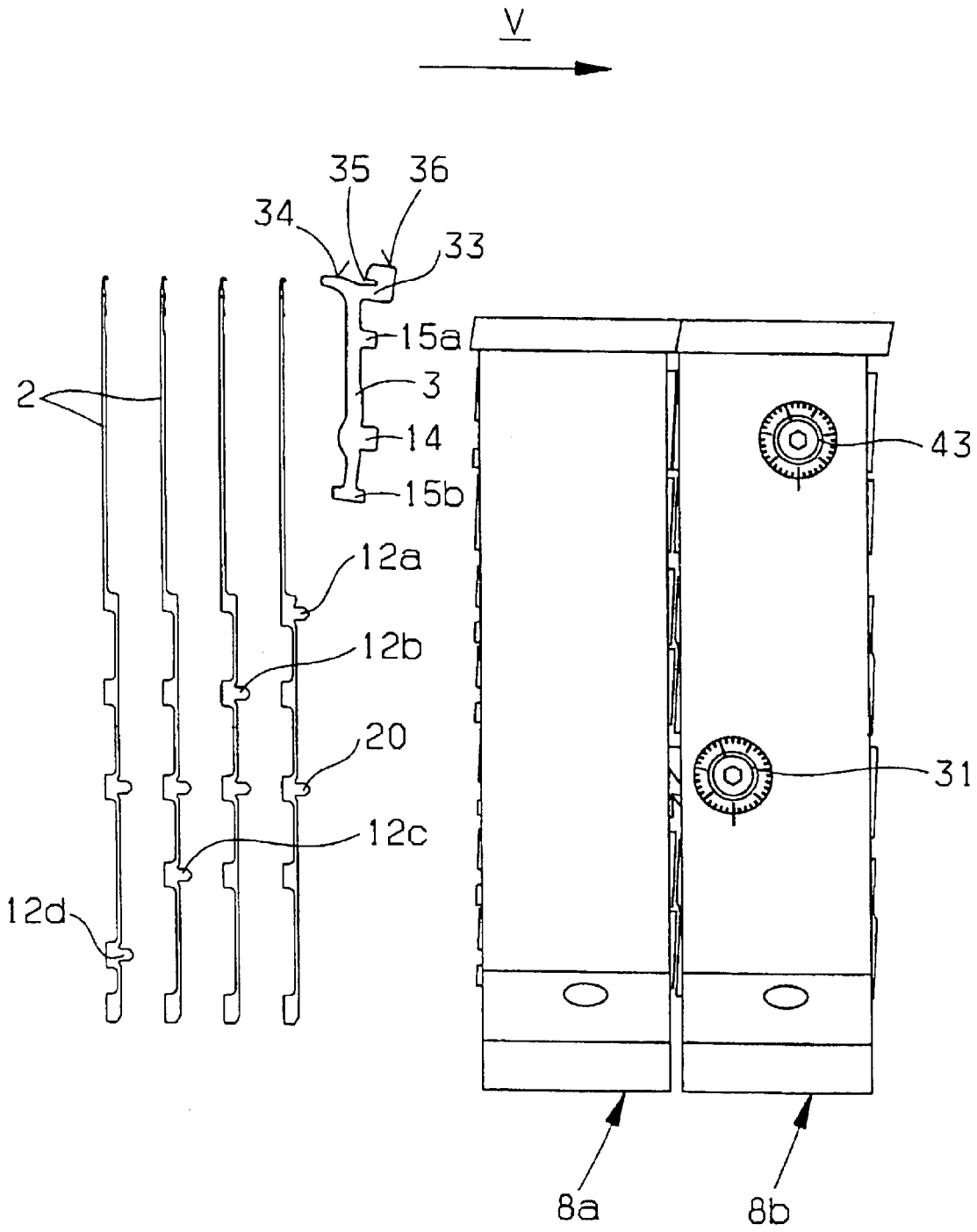
Figure 3:
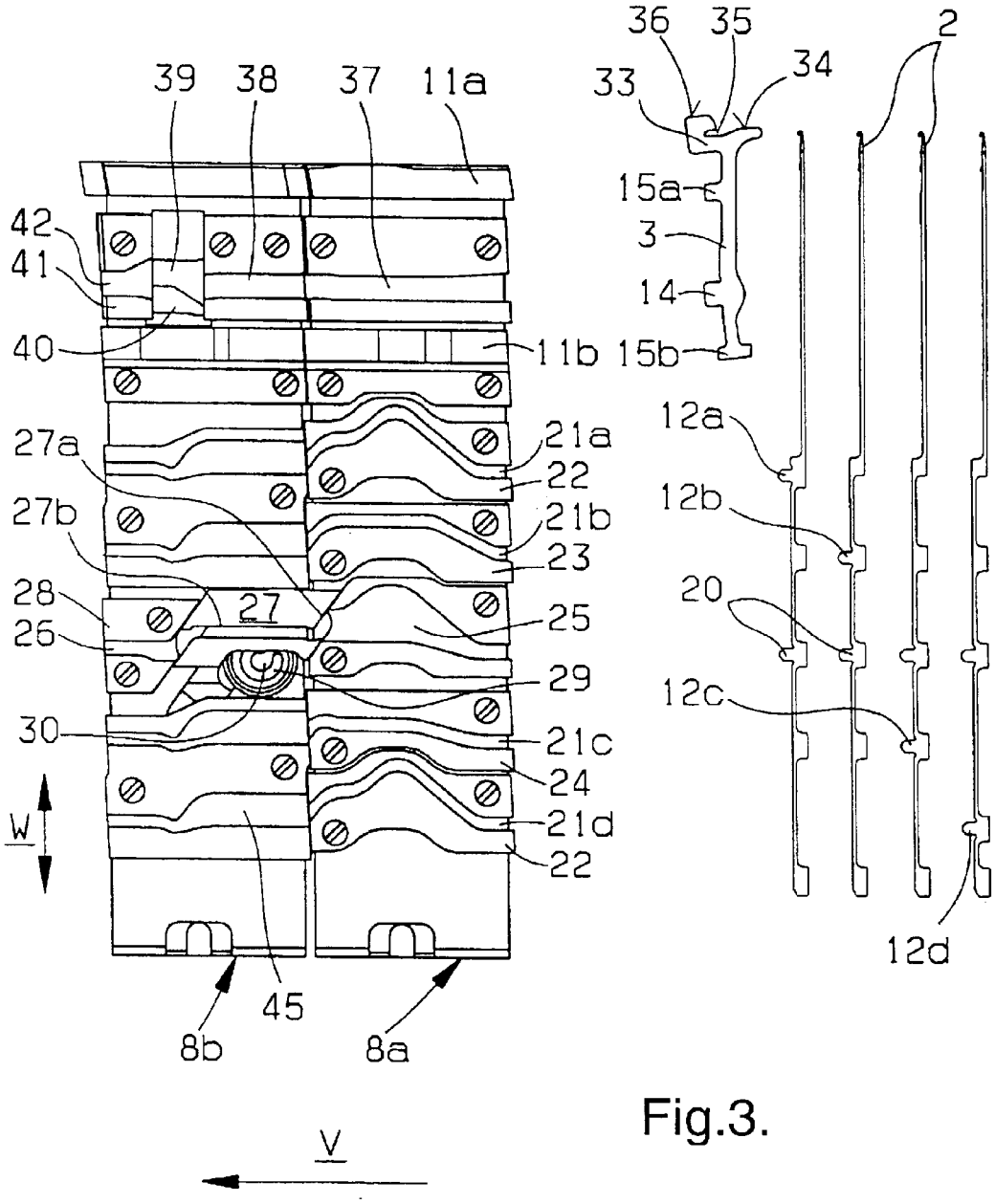

The basic structure of a circular knitting machine according to the invention is shown in FIGS. 1 to 3 in the example of a circular knitting machine and an embodiment which is currently held to be the best one. The circular knitting machine contains a support 1, for example a conventional needle and sinker cylinder which has axially parallel guides in a lower region, between which knitting tools in the form of knitting needles 2 for example, here especially latch needles, are mounted so as to be displaceable parallel to the axis of the support 1. In an upper region, the support 1 is provided with additional axially parallel guides, between which customary holding-down/knocking-over sinkers 3 are mounted. The sinkers 3 are mounted so as to be displaceable parallel to the axis of the support 1 and can moreover carry out the customary holding-down movements transversely and radially with respect thereto. The sinkers 3 are disposed at the same spacing as the needles 2 in the carrier 1 but are staggered with respect to the needles 2, such that in each case one sinker 3 comes to lie between two needles 2.

The support 1 is supported in a machine frame, not shown in greater detail, on a carrier ring 4, and arranged with its axis coaxial with a machine axis which is not shown but is vertical here. The carrier ring 4 is mounted so as to be rotatable together with the support 1 about the machine axis and to this end is provided with an outer toothed ring 5 which engages with a driving pinion, not shown, which can be made to rotate by a drive motor of the circular knitting machine.

In a fixed carrier ring 6 is secured a base plate 7 on which a stationary cam housing 8, surrounding the support 1, is mounted. To this cam housing 8 are secured cams 9, 10 and 11*a*, 11*b*, which face the support 1 and are explained in greater detail further on, these cams cooperating with radially outwardly projecting butts 12 of the needles 2 or respectively 14 and 15*a*, 15*b* of the sinkers 3. Here the arrangement according to the so-called relative technique is such that the needles 2 and the sinkers 3 can carry out movements parallel to the machine axis but in opposite directions for the purpose of forming stitches with the aid of butts 12, 14 and cams 9, 10. Moreover the sinkers 3 can in addition be swivelled radially with respect to the support 1 by means of the butts 15*a*, 15*b* and cams 11*a*, 11*b*.

Furthermore the circular knitting machine has a plurality of holding devices 16 which are supported on the carrier ring 6 by means of supports 17 and bear a thread guide ring 18, from which thread guides 19 hang down, by means of which threads, not shown, can be supplied in a manner known per se to raised needles 2.

Circular knitting machines of this type are generally known (e.g. DE 33 11 361 C2 and DE 39 28 986 C2) and therefore do not need to be explained in detail.

As FIGS. 2 and 3 show in particular, the needles 2 of a circular knitting machine according to the invention, each have a butt 12*a*, 12*b*, 12*c* and 12*d*, hereinafter described as the selector butt, in each of four planes lying the one above the other. In a central plane, each needle 2 is moreover provided with a butt 20 hereinafter described as the knitting butt. Correspondingly the cam housing 8 has in at least one knitting system, preferably in a plurality of knitting systems in each case a first segment serving to select the needle 8*a* and an adjacent second segment 8*b* serving to form the stitch, the segment 8*a* being arranged in front of segment 8*b* in the direction of rotation of the support 1 (arrow v in FIG. 3).

The segments 8*a* and 8*b* from knitting systems of the knitting machine.

As can be seen from FIG. 3, segment 8*a* cooperates in particular with selector butts 12*a* to 12*d* of the needles 2 and for this purpose has, instead of cam 9 in FIG. 1, four needle tracks 21*a* to 21*d* lying the one above the other and formed by cams. Needle tracks 21*a* and 21*d* are raising tracks and are each delimited from below by a raising cam 22, which lifts needles 2 with the selector butts 12*a* and 12*d* into a completely raised knitting position. Needle track 21*b* acts on the selector butts 12*b*, is delimited on the lower side by a raising cam 23 which lifts associated needles with selector butts 12*b* into a tuck position, and is also a raising track. Needle track 21*c* is a pass track (run through track) and has a cam 24 which guides needles 2 with butts 12*c* in such a way that they remain in a pass or miss-knit (non-knitting) position. In the region of the knitting butts 20, segment 8*a* has a recess 25 which is so big that the knitting butts 20, set independently thereof, remain uninfluenced by which of the selector butts 12*a* to 12*d* the associated needle 2 is ever provided with. Moreover, the needle tracks 21*a* to 21*d* end in the direction of the arrow v in each case at a height which lies above that height corresponding to the pass height which they have at the beginning of segment 8*a*, as FIG. 3 shows. This serves the correct transfer of the knitting needles 2 when changing from segment 8*a* to segment 8*b*.

Segment 8*b* has according to FIG. 3 a needle track 26 associated with the knitting butts 20. This is delimited from above in a section adjoining segment 8*a* by a first drawing-down or preliminary loop sinking cam 27 and then by a second drawing-down or final loop sinking cam 28 following same. The first drawing-down cam 27 has initially, as FIG. 3 shows in particular, a drawing-down edge 27*a* and then a holding edge 27*b*, following in the direction of arrow v, which extends substantially horizontally and guides the associated knit needles 2 with their knitting butts 20 in an intermediate position extending between the tuck position and the pass position. Here the two edges 27*a*, 27*b* in the embodiment are formed on a single cam for the sake of simplicity, although they could also be attached to two adjacent cams.

According to the invention, an eccentric 29 (FIG. 3) is associated with the drawing-down cam 27*a*, and is secured to a pintle 30 passing through segment 8*b*. At an end of the pintle 30 accessible from the outside of segment 8*b* is secured an adjusting knob 31 (FIGS. 1 and 2), with which the first drawing-down and preliminary loop sinking cam 27, and with it in this embodiment the drawing-down edge 27*a* and the holding edge 27*b*, can be displaced upwards or downwards parallel to tile machine axis (arrow w in FIG. 3). The second drawing-down and final sinking cam 28 is on the other hand preferably arranged stationary in the circular knitting machine according to the invention and therefore cannot be adjusted. It contains, when viewed in the direction of arrow v, preferably first a drawing-down edge 28*a*, only indicated in FIG. 4, which merges towards the end of segment 8*b* into a substantially horizontal section 28*b* and thereafter into a somewhat rising section 28*c*, which serves to loosen newly-formed stitches. Moreover it can be seen from FIG. 3 that the needle tracks 21*a* to 21*d* and 26 are formed as far as possible as closed needle tracks by counter-cams which stand opposite cams 22, 23, 24, 27 and 28 at a spacing which corresponds substantially to the height of the, respective butts 12, 20, in order to be able to guide the needle butts 12, 20 reliably and in a practically positive manner even at very high speeds of the support 1. Moreover the cams 22, 23, and 24 are preferably secured to segment 8*a* in an easily exchangeable manner, so that different cams can be associated with the butts 12 in dependence on the desired pattern.

According to FIGS. 1 to 3, as well as being provided with butts 14 and 15*a*, 15*b*, the sinkers 3 are also each provided with a sinker head 33 which in customary manner has a knocking-over edge 34, a throat 35, intended to enclose the stitches, and an upper edge 36 which is formed on a sinker portion delimiting the throat 35 from above.

Figure 4:
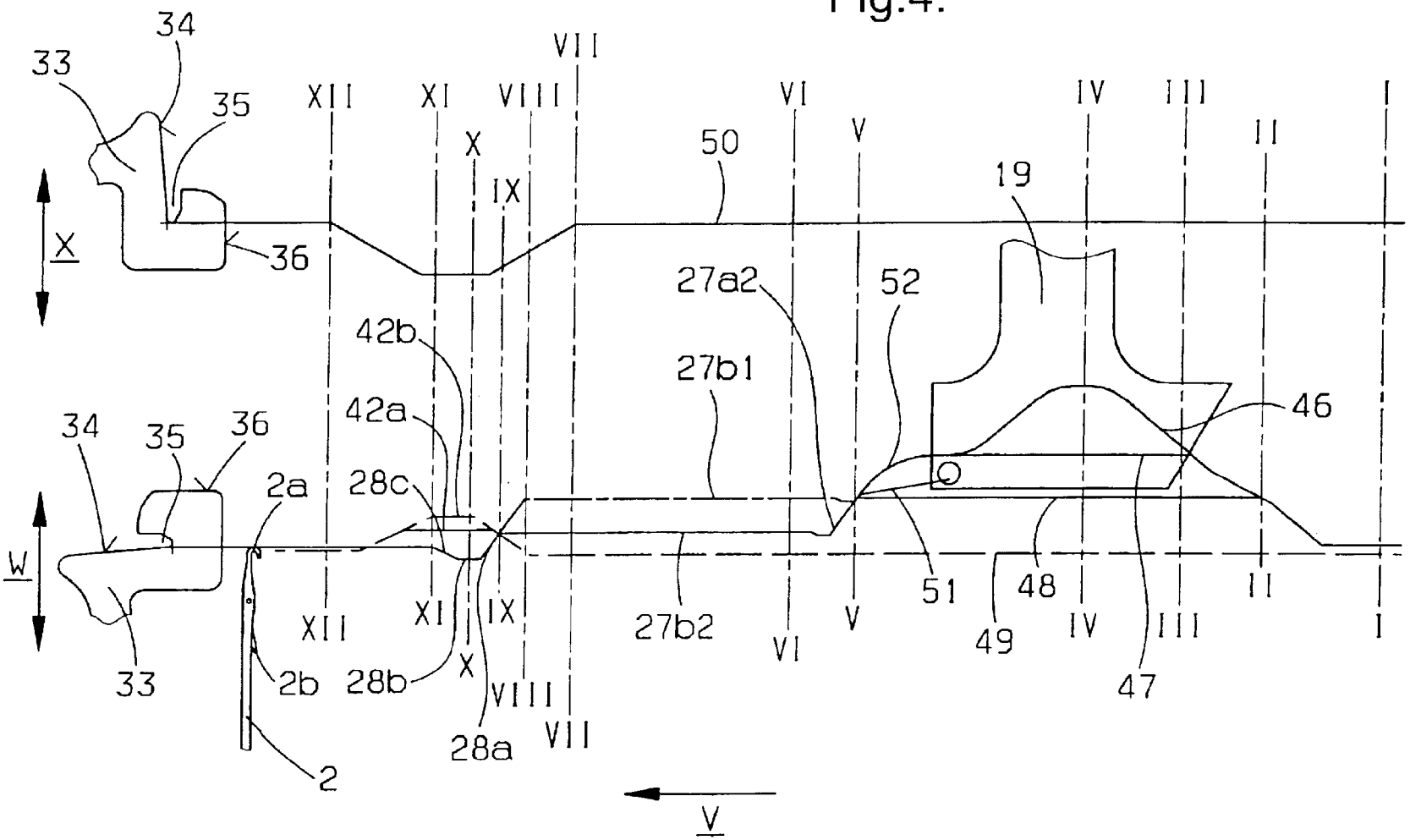
FIG. 4 a schematic and enlarged view of the needle and sinker tracks arising in a knitting system according to FIGS. 2 and 3.

The butts 14 of the sinkers 3, described below as raising butts, cooperate in the region of cam segment 8*a* with a pass track 37 which extends in a horizontal plane and leaves the sinkers 3 uninfluenced. In the region of segment 8*b*, this pass track 37 is initially continued by a track section 38 up to a point which lies in the direction of arrow v shortly before a point at which the holding edge 27*b* ends. Communicating with track section 38 is then a track section 39 which is delimited from below by a raising cam 40 and lies in the direction of arrow v substantially where the drawing-down cam 28 has its drawing-down edge 28*a* (FIG. 4). Adjoining the raising cam 40 is then finally a track section 42 formed by a continuous run-through cam 41, which section is disposed substantially where the loop sinking cam 28 has its horizontal section 28*b*.

According to the invention there is associated with the raising cam 40, analogously to the drawing-down cam 27, an eccentric which is not shown and which is secured to a pintle protruding through segment 8*b*. At an end of the pintle which is accessible from the outside of segment 8*b* is secured an adjusting knob 43 (FIGS. 1 and 2), with which raising cam 40 can be adjusted upwards or downwards parallel to the machine axis (arrow w in FIG. 3). Cam 41, on the other hand, is disposed fixed. Moreover it can be seen from FIG. 3 that the sinker tracks 37, 38, 39 and 42, similarly to the needle tracks, are formed as closed tracks preferably by corresponding counter-cams. Here a portion of segment 8*b* formed by the track sections 39, 42 on the one hand and the second drawing-down or final loop sinking cam 28 on the other hand is described in short below as the stitch-formation section.

The tracks adjoining in segment 8*b* the needle tracks 21*a* to 21*d* are, where there is action on the selector butts 12*a* to 12*d*, provided with sufficiently large recesses so that the selector butts 12*a* to 12*d* do not cause any collisions during the needle movements caused with the aid of the knitting butts 20 and remain uninfluenced in segment 8*b* (cf. e.g. a recess 45 in the extension of track 21*d*).

The butts 15*a*, 15*b* of the sinkers 3, described below as swivel butts, cooperate with the associated swivel cams 11*a*, 11*b* (FIG. 1) and for this purpose are guided along corresponding tracks by segments 8*a*, 8*b*. Since the radial pivoting of the sinkers 3 thereby caused is known inter alia from the document DE 39 28 986 C2, that document is hereby incorporated by reference in the subject matter of the disclosure of the present application and a detailed description of cams 11*a*, 11*b* is dispensed with.

The various components of the described circular knitting machine are so configured and so arranged relative to one another that the operating manner described below with the aid of FIGS. 4 to 15 is possible.

In FIG. 4, a knitting system formed by segments 8*a* and 8*b* (FIG. 3) is shown schematically and on an enlarged scale. Indicated first of all with continuous lines are those tracks 46 to 48 on which hooks 2*a* of needles 2 can be guided under the control of cams 22 to 24 according to FIG. 3. Furthermore, indicated with a broken line is a track 49, on which the knocking-over edges of the sinkers 3 are guided under the control of tracks or track portions 37, 38 or of raising cams 40, 41, according to FIG. 3. The movements take place here on the one band in the direction of arrow v and on the other hand in the direction of arrow w which is perpendicular thereto. Finally in the upper region, a track 50 of the sinker heads 33 is indicated which are swivelled by means of butts 15*a*, 15*b* of sinkers 3 and cams 11*a*, 11*b* according to FIG. 3 radially with respect to the machine axis in the direction of an arrow x.

Figure 5:
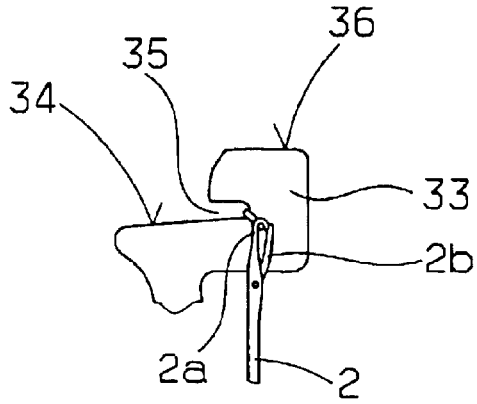
FIGS. 5 to 15 schematically, the relative positions of the knitting needles and sinkers during a knitting process at the points designated in FIG. 4 by I—I to XII—XII.
Figure 6:
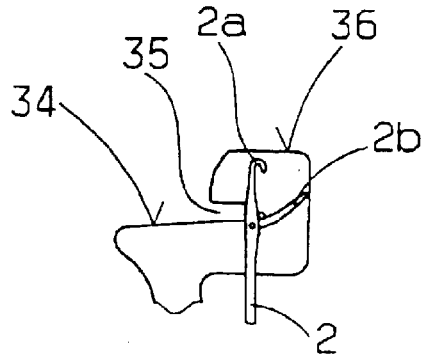
Figure 7:
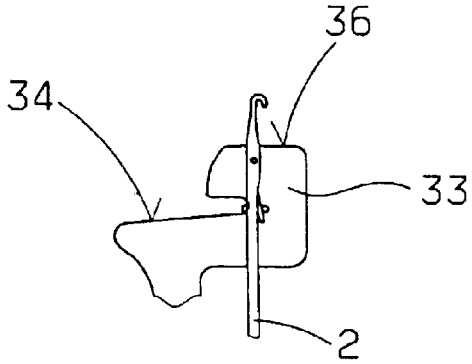
Figure 8:
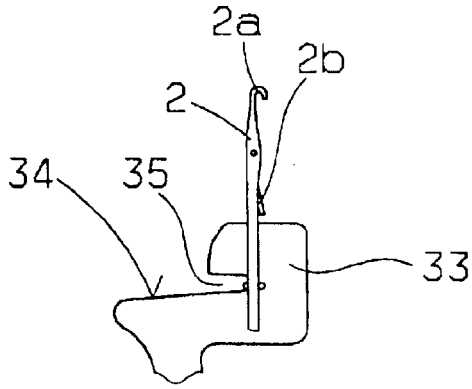

It is initially assumed that a raising cam 22 is associated with each of the selector butts 12*a* to 12*d* in FIG. 3. Therefore, if the needles run into the knitting system segment 8*a* according to line I—I in FIG. 4, then all the needles follow track 46, such that they are raised initially up to a line IV—IV in FIG. 4, on passing the thread guide 19 pick up a thread 51 and are then drawn down again slightly to line V—V in FIG. 4 along a track section 52. The old stitches lie here initially in the hooks closed by latches 2*b* of needles 2 and in the throats 35 of sinkers 3 (FIG. 5 and line I—I in FIG. 4). When the needles 2 are raised into the highest position (FIG. 8 and line IV—IV in FIG. 4), the old stitches then gradually slide below the opening latches 2*b* onto the needle shafts, so that the new thread 51 can enter the open hooks 2*a* on passing the thread guide 19. Due to the partial withdrawal of the needles 2 along track section 52, the tongues 2*b* are closed again by the old stitches.

Needles 2 now reach the region of the first drawing-down and preliminary loop sing cam 27 and its holding edge 27*b*

Figure 9:
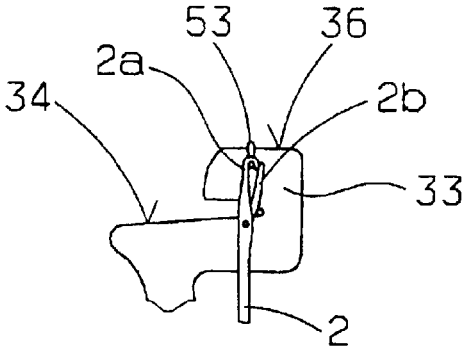
Figure 10:
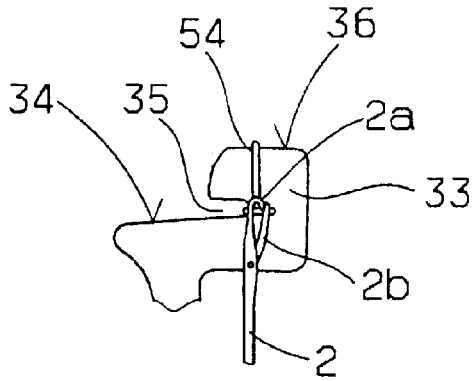

(FIG. 3 and FIG. 4). If the drawing-down cam 27 is set by means of the eccentric 29 in its highest position, the needles 2 then follow a track 27*b*1 shown in a dot-dash line between lines V—V and VIII—VIII in FIG. 4. The drawing-down edge 27*a* is here practically ineffective such that the needles 2 substantially retain their intermediate position which is clear from FIG. 9 and is present when they reach the drawing-down cam 27, and the thread is therefore drawn only with comparatively short loops 53 over the upper edges 36 of the sinkers 3 (FIG. 9 and line V—V in FIG. 4), If, on the other hand, the drawing-down and preliminary loop sinking cam 27 is in its lowest position, then the needles 2 follow a track 27*a*2–27*b*2 represented in a continuous line in FIG. 4, by which means the new thread 51 is drawn over the upper edges 36 into comparatively long loops 54 (FIG. 10 and line VI—VI in FIG. 4). Naturally all the possible loop lengths between FIGS. 9 and 10 can be set continuously by means of the eccentric 29.

Later on, the needles 2 remain in the intermediate positions shown in FIG. 9 or 10, such that the preformed loops 53 or 54 remain substantially uninfluenced until they reach line VIII—VIII in FIG. 4.

Figure 11:
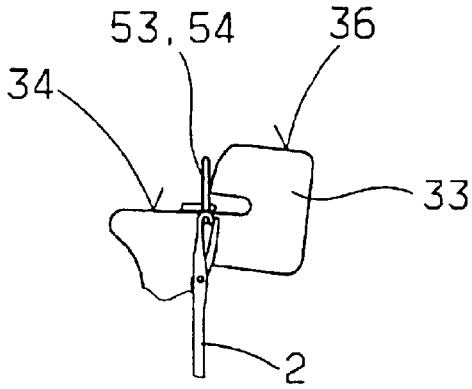
Figure 12:
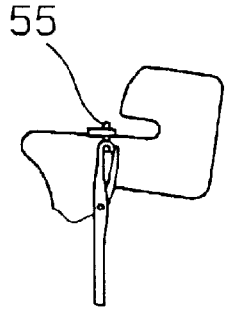
Figure 13:
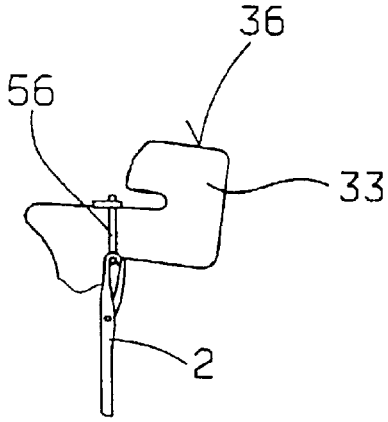
Figure 14:
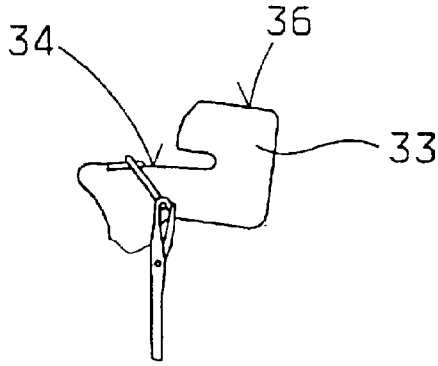
Figure 15:
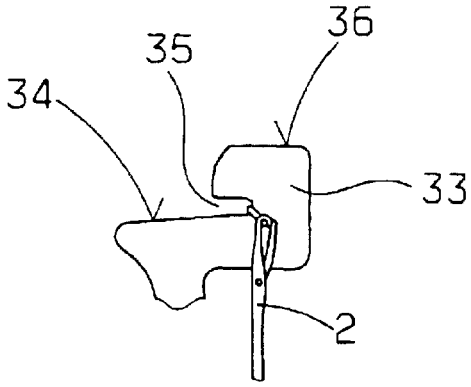

Roughly from a line VII—VII and until reaching a line IX—IX in FIG. 4, there is a radially outwardly directed swivelling of the sinkers 3, which up to then have been swivelled radially inwards, this being caused by a common action of the swivel butts 15*a*, 15*b* and swivel cams 11*a*, 11*b* FIG. 1. As a result of this, the previously preformed loops 53 or 54 slide gradually from the upper edges 36, used for preforming (preliminary loop sinking), onto the knocking-over edges 34 of sinkers 3, serving the stitch formation (final loop sinking), as is indicated in FIG. 11 for the region of line IX—IX in FIG. 4.

Simultaneously the needles 2 and sinkers 3 enter the stitch-formation section of cam segment 8*b*, which lies roughly between lines VIII—VIII and XI—XI in FIG. 4 and is defined by cams 28, 40 and 41 (FIG. 3). As a consequence of this, on the one hand the sinkers 3 are raised in an axially parallel manner and on the other hand the needles 2 are taken down in an axially parallel manner, and thus the old stitches are knocked over the newly-formed loops 53, 54 and new stitches 55, 56 (FIG. 12 or 13) are formed (final loop sinking) until roughly the line X—X in FIG. 4 is reached. In order here to guarantee good shaping of the new stitches 55, 56, the raising cam 40 is adjusted by means of the adjusting knob 43 (FIG. 1) in as precise a manner as possible, so that the combined drawing-down and raising movements of the needles 2 and sinkers 3 correspond as exactly as possible to the length of the loops 53, 54 set during the preforming process (FIGS. 9, 10). Thus for example during the final sinking of loop 53, a comparatively low raising height is selected for the raising cam 41, such that the sinkers 3 are guided along a continuous track section 42*a* (FIG. 12 and line X—X in FIG. 4) whilst in the final sinking of loops 54 a large raising height is selected corresponding to a track section 42*b* shown in a broken line (cf. FIG. 13 and line XI—XI in FIG. 4). Thereafter the formed stitches 55 or 56 are slightly relaxed along track section 28*c* of the needles 2 (FIG. 14) such that the needles 2 can assume again their initial positions as at line I—I of FIG. 4. The sinkers 3 are also guided back into their initial position at the end of the knitting system (FIG. 15 and line XII—XII in FIG. 4), which position they had also assumed on running into the knitting system (line I—I in FIG. 4). The type of stitch-formation described can therefore be repeated in a subsequent knitting system.

Figure 16:
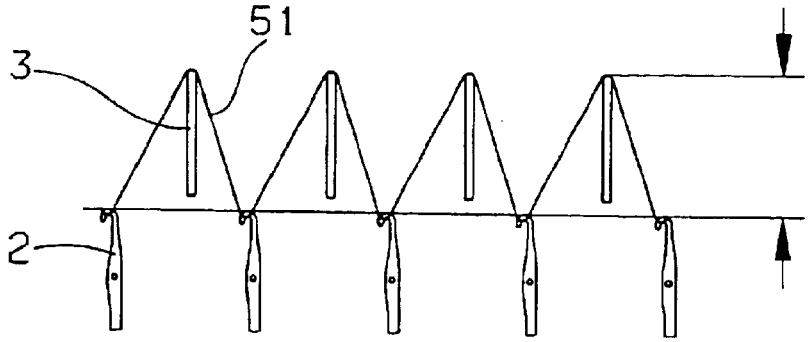
FIGS. 16 to 18 schematically, the preforming of thread loops having a minimum and a maximum length, respectively, FIGS. 19 to 21 schematically, the stitch formation using the preformed thread loops according to FIGS. 16 to 18.
Figure 17:
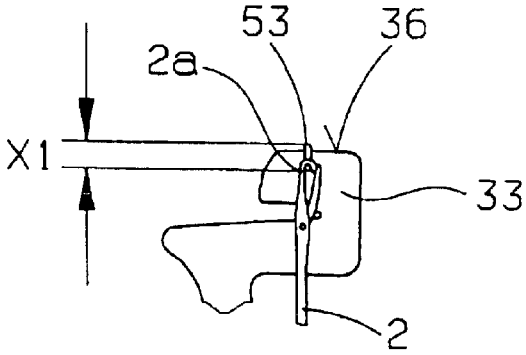
Figure 18:
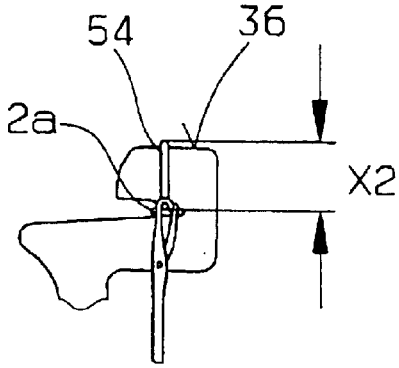

The type of preliminary loop sinking according to the invention is clear in particular from FIGS. 16 to 18. Here FIG. 17 shows the preliminary sinking of the short loops 53 (cf. also FIG. 9) and FIG. 18 shows the formation of the long loops 54 (cf. also FIG. 10) according to a measurement x1 or respectively x2 which is determined by the spacing of the upper edges 36 of the sinkers 3 from the needle hooks 2*a* holding the loops 53, 54. The maximum loop length x2 (FIG. 18) is here determined by the position of the old stitch on the knocking-over edge 34, since the hooks 28 are only drawn down during the preliminary loop sinking to a depth at which they still remain arranged in the old stitches, therefore these are not knocked over since otherwise a new stitch would be formed already. In an advantageous manner, the loop length is moreover fixed by a single adjustable cam, namely the first drawing-down and preliminary loop sinking cam 27.

Figure 19:
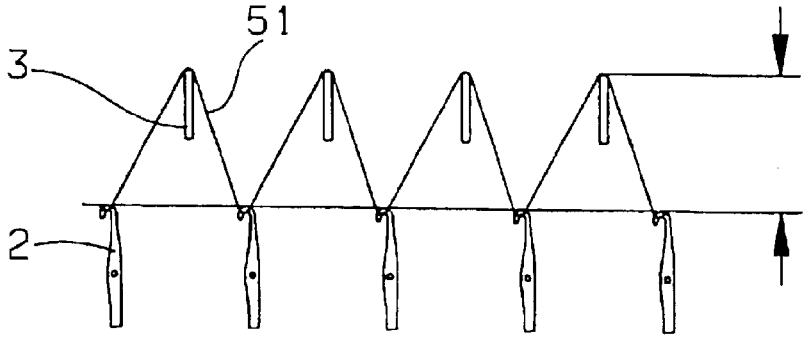

FIGS. 19 to 21 show, similarly to FIGS. 16 to 18, the process of the final loop sinking after the transfer of the loops 53, 54 to the knocking-over edges 34 of the sinkers 3. Here the combined axially parallel movement of the needles 2 and sinkers 3 should be so selected that during the stitch formation the same spacings x1, x2 are produced between the knocking-over edges 34 and the needle hooks 2*a*, as between the upper edges 36 and the hooks 2*a* during the preliminary loop sinking. Here there is the advantage that the stitch length is also fixed by a single cam, namely the raising cam 40. Although there are also other possible ways of dimensioning the loop and stitch lengths, the described solution is preferred because it can be realised with comparatively simple constructional means and because it makes possible comparatively simple and rapid adjustment by the operating staff.

As FIGS. 3 and 4 show, selected needles 2 can also be influenced with the aid of cams 23, 24 in segment 8*b*, such that they pass in FIG. 4 through the tuck or miss-knit track 47 or 48. On passing through the tuck track 47 (FIG. 7 and line III—III in FIG. 4) the needles 2 also pick up the tread 51, such that the preliminary loop sinking is carried out in the same way as described above. On the other hand, on passing through track 48 (FIG. 6 and line II—II in FIG. 4) the thread 51 is not inserted into the needle hooks 2*a* but laid over the relevant sinkers 3. The needles 2 moved on track 48 are however guided at line V—V of FIG. 4, like the remaining needles 2, to the first drawing-down and preliminary loop sinking cam 27.

By comparison with the above-described case, shown in FIG. 22, in which all the needles 2 form a stitch, a float pattern is shown in FIG. 23. It is assumed here that in FIG. 3 respectively three successive needles 2 are diverted into a pass track 21*c* and for this purpose e.g. three of the four needle tracks 21*a* to 21*d* are realised by a continuous run-through cam 24. On the other hand, every fourth needle 2 is guided through a knitting track 21*a* which is defined by a raising cam 22. The knitwear obtained with this type of knitting is distinguished by the fact that according to FIG. 23 a stitch 58 is formed only on each fourth needle 57 and between these stitches float loops 59 are produced extending over three needles 2.

Since the preformed loops 53, 54 have to be transferred before the stitch formation according to FIG. 11 from the upper edges 36 onto the knocking-over edges 34 of the sinkers 3, the thread portions 51*a* located behind the last needle which is knitting (e.g. 57*a* in FIG. 23), are directly connected to a thread portion 51*b* coming from the thread guide 19. If therefore the next knitting needle (e.g. 57*b* in FIG. 23) is picking up the dread 51 precisely at the moment at which the loop to be processed by needle 57*a* slides from the upper edge 36 onto the knocking-over edge 34 of the respective sinker 3, there is the danger that the preformed loop forms back and is drawn over the float loop at least partially into the new loop to be formed. In this way faults are produced which are visible in the finished knitted fabric. In order to avoid this, according to the invention provision is made for giving the holding edge 27*b*, situated between the raising cam 22 and the second drawing-down cam 28, (corresponding to the spacing between lines V—V and VIII—VIII in FIG. 4) a certain minimum length L (FIG. 23). This length L is preferably selected so large that at least one needle 57*a* but preferably two or three needles 57*a*, 57*c* and 57*d* are present which have already formed a preformed loop 58, before a further needle (here e.g. 57*e*) is used for loop formation. Conversely the length of the float loops is selected smaller than corresponds to length L. This guarantees that the loop respectively in transition from the upper edge 36 onto the knocking-over edge 34 of the sinker 3 (e.g. needle 57*e* in FIG. 23) cannot be formed back by tension from the next knitting needle 57*b*. In the embodiment of FIG. 23, the holding edge 27*b* has for this purpose a length L which corresponds to a multiple of a needle spacing, preferably at least 12 times.

The invention is not restricted to the described embodiments which can be modified in many ways. This applies in particular to the configuration of the tracks for the various needle and sinker butts selected in the individual case, since there are numerous different possibilities. For example the first drawing-down cam 27 could be so configured that its drawing-down edge 27*a* extends as far as the point at which the knitting needles 2 reach their highest position and therefore also contains section 52 in FIG. 4. Also the arrangement of the butts 12 on the needles 2 can be of any type, although it is preferred to make the butts 12*a* to 12*d* follow one another alternating in the support 1. Moreover the invention is not limited to the described circular sinking machine but can, with corresponding modification, also be applied to rib circular knitting machines, circular knitting machines with a stationary support 1 and a rotating cam housing, or even to flat knitting machines. An application of the described principle to knitting machines having tubular needles is also possible. At the same time it is clear that all these machines can also be used to process something other than metal wires or the like. Finally it goes without saying that the various features can also be applied in other combinations than those described and illustrated.

It will be understood, that each of the elements described above or two or more together, may also find a useful application in other types of construction differing from the types described above.

While the invention has been illustrated and described as embodied in a circular knitting machine, it is not intended to be limited to the details shown, since various modifications and structural changes may be made without departing in any way from the spirit of the present invention.

Without further analysis, the forgoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of producing knitwear which has stitches, on a knitting machine provided with knitting needles and holding-down/knocking-over sinkers associated therewith, the method comprising the steps of raising the knitting needles of at least one knitting system to pick/up threads; taking down said raised knitting needles into an intermediate position in order to preform said threads which have been picked-up over the sinkers to form loops of pre-selected lengths; and forming the stitches by drawing down said knitting needles from said intermediate position into a lowermost position and raising said sinkers in an opposite direction.

2. A method as defined in claim 1; and further comprising determining a length of said loops solely by said drawing down of said knitting needles into said intermediate position.

3. A method as defined in claim 1; and further comprising taking into account a length of said loops in said stitch forming step solely by said raising of said sinkers.

4. A method as defined in claim 1; and further comprising in each of knitting systems of the knitting machine, transferring a plurality of adjacent ones of said knitting needles into said intermediate position after picking up said threads and holding beside one another in said intermediate position; limiting a length of float loops which are produced at said knitting system by selected ones of said knitting needles not being raised to pick up said threads, to a pre-selected value; and holding said knitting needles which are not raised to pick up said threads, in said intermediate position over a length which corresponds to a multiple of said pre-selected value.

5. A knitting machine for producing knitwear which has stitches, comprising a support; knitting needles and holding-down knocking-over sinkers disposed in said support alternatingly beside one another; at least one knitting system having a raising cam to raise said knitting needles, at least one thread guide to lay a thread into said knitting needles which have been raised, and a stitch-formation section with cams for providing opposite movements to said knitting needles and said sinkers in order to form stitches from said threads which have been laid-in, said knitting system between said raising cam and said stitch-formation section having a drawing-down edge drawing a raised knitting needle down into an intermediate position, to form thread loops over said sinkers.

6. A knitting machine as defined in claim 5, wherein said drawing-down edge is adjustable to assume a position for setting a length of said thread loops.

7. A knitting machine as defined in claim 5, wherein said stitch-formation section has a raising cam acting on said sinkers and serving to adapt to a length of said thread loops.

8. A knitting machine as defined in claim 5, wherein said knitting system has, in a portion which has said raising cam, at least one continuous run-through cam for said knitting needles which are not intended to pick up said thread, said knitting needles including knitting needles cooperating only with said raising cam and knitting needles which cooperate only with said continuous cam; and further comprising a holding edge provided between said drawing-down edge and said stitch-formation section for holding said knitting needles in said intermediate position, said holding edge having a width which is greater than a maximum number of adjacent ones of said knitting needles cooperating with said continuous cam.

9. A knitting machine as defined in claim 8, wherein each of said knitting needles has at least one first butt cooperating with said drawing-down edge and said stitch-formation section, and at least one second butt cooperating with said raising cam or said continuous cam, so that said first butt remains uninfluenced in a region of said raising cam or said continuous cam and said second butt remains uninfluenced in a region of said stitch-formation section.

10. A knitting machine as defined in claim 5, wherein said at least one knitting system has five guide tracks lying one above the other, for butts of said knitting needles, said guide tracks including at least one track provided for one butt present in all said knitting needles and cooperating with said stitch-formation section, said knitting needles having alternately in succession one additional butt cooperating with one of four others of said guide tracks, said cams being exchangeable for knit, tuck or pass and being associated with said other four guide tracks.

11. A knitting machine as defined in claim 8, wherein said holding edge holding said knitting needles in said intermediate position has a width that corresponds at least to a spacing of eight adjacent ones of said knitting needles.

12. A knitting machine as defined in claim 5, wherein said knitting machine is configured as a circular knitting machine.

* * * * *